US006281183B1

(12) United States Patent
Harbour

(10) Patent No.: US 6,281,183 B1
(45) Date of Patent: Aug. 28, 2001

(54) PROCESS FOR PRODUCING A WATER SOLUBLE PACKAGE

(75) Inventor: Richard Harbour, Merseyside (GB)

(73) Assignee: Unilever Home & Personal Care, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/525,080

(22) Filed: Mar. 14, 2000

(30) Foreign Application Priority Data

Mar. 17, 1999 (GB) ..... 9906171

(51) Int. Cl.[7] ..... C11D 17/04; B29C 51/10

(52) U.S. Cl. ..... 510/406; 510/120; 510/140; 510/296; 510/439; 264/553; 264/571

(58) Field of Search ..... 510/439, 296, 510/406, 120, 140; 264/553, 571

(56) References Cited

U.S. PATENT DOCUMENTS

| | | | | |
|---|---|---|---|---|
| 2,377,188 | | 5/1945 | Weisman | 99/77.1 |
| 3,892,905 | | 7/1975 | Albert | 428/220 |
| 3,958,394 | | 5/1976 | Mahaffy et al. | 53/112 |
| 4,416,791 | | 11/1983 | Haq | 252/90 |
| 4,562,717 | | 1/1986 | Shimizu et al. | 72/347 |
| 4,610,799 | | 9/1986 | Wilsberg et al. | 252/90 |
| 4,846,992 | | 7/1989 | Fonsmy | 252/90 |
| 4,969,927 | | 11/1990 | Schumann et al. | 8/159 |
| 4,971,748 | | 11/1990 | Sado et al. | 264/553 |
| 4,973,416 | | 11/1990 | Kennedy | 252/90 |
| 5,224,601 | | 7/1993 | Gouge et al. | 428/220 |
| 5,227,177 | | 7/1993 | Reil et al. | 425/388 |
| 5,394,603 | | 3/1995 | Reil et al. | 29/463 |
| 5,500,067 | * | 3/1996 | Jenkner | 156/146 |
| 5,529,224 | | 6/1996 | Chan et al. | 222/212 |
| 5,534,178 | * | 7/1996 | Bailly et al. | 510/367 |
| 5,665,824 | | 9/1997 | Chang et al. | 525/185 |

FOREIGN PATENT DOCUMENTS

| | | |
|---|---|---|
| 9700361 | 12/1986 | (BE) . |
| 93 03 456 | 6/1993 | (DE) . |
| 19521 140 | 12/1996 | (DE) . |
| 298 01 621 | 4/1998 | (DE) . |
| 0 079 712 | 5/1983 | (EP) . |
| 0 157 612 | 10/1985 | (EP) . |
| 160 254 | 11/1985 | (EP) . |
| 0 266 583 | 5/1988 | (EP) . |
| 0 272 796 | 6/1988 | (EP) . |
| 158 464 B1 | 7/1989 | (EP) . |
| 0 343 069 | 11/1989 | (EP) . |
| 0 343 070 | 11/1989 | (EP) . |
| 0 347 221 | 12/1989 | (EP) . |
| 0 366 231 | 5/1990 | (EP) . |
| 0 373 395 | 6/1990 | (EP) . |
| 0 518 689 B1 | 12/1992 | (EP) . |
| 0 291 198 | 11/1993 | (EP) . |
| 0 608 910 | 3/1994 | (EP) . |
| 0 593 952 | 4/1994 | (EP) . |
| 0 389 513 | 7/1994 | (EP) . |
| 0 700 989 | 3/1996 | (EP) . |
| 0 718 199 | 6/1996 | (EP) . |
| 0 746 514 | 12/1996 | (EP) . |
| 0 748 673 | 12/1996 | (EP) . |
| 0 941 939 | 9/1999 | (EP) . |
| 2 601 930 | 1/1988 | (FR) . |
| 2 724 388 | 3/1996 | (FR) . |
| 631484 | 11/1949 | (GB) . |
| 989 350 | 4/1965 | (GB) . |
| 1 381 376 | 1/1975 | (GB) . |
| 2 060 544 | 5/1981 | (GB) . |
| 2 090 603 | 7/1982 | (GB) . |
| 2 118 961 | 11/1983 | (GB) . |
| 2 211 196 | 6/1989 | (GB) . |
| 2 221 158 | 1/1990 | (GB) . |
| 2 257 388 | 1/1993 | (GB) . |
| 2 259 883 | 3/1993 | (GB) . |
| 2 305 931 | 4/1997 | (GB) . |
| 89/04282 | 5/1989 | (WO) . |
| 92/17382 | 10/1992 | (WO) . |
| 96/00251 | 1/1996 | (WO) . |
| 96/29189 | 9/1996 | (WO) . |
| 97/00282 | 1/1997 | (WO) . |
| 97/27743 | 8/1997 | (WO) . |

OTHER PUBLICATIONS

Derwent Abstract of DE 12 87 502.
Derwent Abstract of JP9087105, Mar. 31, 1997.
Derwent Abstract of FR 2684594, Jun. 11, 1993.
Derwent Abstract of FR 2675734, Oct. 30, 1992.
Derwent Abstract of EP 0 343 069, Nov. 23, 1989.
Derwent Abstract of EP 0 373 395, Jun. 20, 1990.
Derwent Abstract of FR 2 601 930, Jan. 29, 1988.

* cited by examiner

*Primary Examiner*—Lorna M. Douyon
(74) *Attorney, Agent, or Firm*—Rimma Mitelman

(57) ABSTRACT

A process for producing a thermoformed package comprises the steps of placing a first sheet of film over a forming die having at least one cavity, heating the film to mould the film into the at least one cavity thereby forming at least one recess in the film, placing a composition in the at least one formed recess, and sealing a second sheet of film across the at least one formed recess to produce at least one closed package. Once formed, the or each recess is substantially retained in its formed orientation by the application of a vacuum through the or each cavity.

3 Claims, No Drawings

PROCESS FOR PRODUCING A WATER SOLUBLE PACKAGE

INTRODUCTION

The invention relates to a process for producing a thermoformed package of the type comprising the steps of placing a first sheet of formable film over a forming die having a cavity, moulding the film into the cavity thereby forming a recess in the film, placing a composition in the thus formed recess, and sealing a second sheet of film across the recess to close the package. In particular, the invention relates to such a process for producing a water-soluble package containing a detergent composition.

Detergent compositions for the machine washing of laundry are provided in many forms. Probably the most prevalent form of laundry detergent is washing powder or granules. A problem with the use of these forms of detergent is that the product needs to be dosed into the machine in such a way that the detergent is quickly and thoroughly dissolved in the wash water of the machine without coming into contact with the laundry in a solid form. In this regard many dosing devices which overcome this problem have been proposed. One such device disclosed in European Patent Nos. 0 343 070 and 0 343 069 teaches the use of a flexible fabric sock which holds the particulate detergent in the machine, the fabric of the sock being permeable to water so as to allow water enter the sock and carry the detergent out of the sock through the fabric walls in the form of an aqueous solution. More recently unit dose forms of detergent have been proposed in the form of compressed tablets of detergent powder. A problem encountered with the provision of detergent tablets is that the tablets need to be strong enough to withstand storage and transport, yet weak enough to disintegrate and dissolve quickly in the washing machine.

A further problem is the need to prevent the tablets "posting" in the porthole and between the drums of conventional washing machines. More recently these problems have been overcome by the provision of detergent tablets having specific chemical disintegrants which allow quick disintegration of the tablets in the aqueous environment of a washing machine, and by the provision of loosely fitting net bags which aid tablet disintegration and prevent "posting". However, as many of the current detergent tablets contain bleach and other irritant substances, the problem of handling the tablets remains.

The provision of detergent compositions in water-soluble films has been known for some time. Most of the documents relating to this subject describe water soluble film envelopes formed using a vertical form-fill-seal (VFFS) route. A problem with envelopes produced using this VFFS method is that, due to the constraints of the process, the resultant envelopes have seals which incorporate defined weak points where the seals overlap at corners. This results in envelopes, which are easily corrupted as a result of impacts suffered during transport. In an attempt to overcome the problems associated with such VFFS envelopes, European Patent Application No. 0 608 910 describes thermoformed water soluble packages for pesticidal compositions of the above mentioned type, which packages include a seal which does not have any angular intersections with itself. While this specification does provide a partial solution to the problem of weak seals, the thermoforming of water-soluble films results in formed packages having many other weak points. Moreover, the packaging and transport of such packages subjects the formed packages to considerable impact forces. A further problem inherent with thermoforming processes, particularly when the thermoformed package is to contain liquid, is contamination of the seal with liquid, resulting in poor sealing of the packages.

It is an object of the invention to overcome at least some of the above problems.

STATEMENTS OF INVENTION

According to the invention, there is provided a process for producing a thermoformed package of the above-mentioned type, the process being characterised in that, once formed, the or each recess is substantially retained in its formed orientation by the application of a vacuum through the or each cavity. Ideally, the vacuum is maintained at least until completion of the sealing step. In this way, shrinkback of the formed recesses is minimised, thus preventing spillage of the composition contained in the formed recesses onto the sealing area of the film. The extent of vacuum to be applied should be sufficient to retain the formed recesses in their formed orientation without unduly deforming or otherwise damaging the film. In this regard the exact pressure to be applied is variable and depends on the film being formed, the type of composition being added to the recesses, and the temperature and humidity of the forming environment. Typically however, a vacuum of between 0.1 and 10 Bar will be used. The vacuum is preferably applied through at least one aperture in the at least one forming cavity. Ideally, the or each cavity will include a plurality of apertures through which the vacuum is applied. In one embodiment of the invention, the at least one cavity may comprise a porous material through which the vacuum may be applied.

Preferably, the or each cavity in the forming die has a curved edge, wherein at least a portion of the curved edge is formed from a resiliently deformable material. Ideally, a predominant portion, and most preferably a whole, of the curved edge is formed of a resiliently deformable material. In one embodiment of the invention, the curved edge comprises an annular gasket of resiliently deformable material, which gasket is mounted in a circumferential groove around the or each cavity. In such a case, the gasket should be dimensioned such that, when mounted in the groove, an exposed surface of the gasket should be flush with a surface of the cavity.

In a further aspect of the invention, the or each cavity is surrounded by a raised flange, wherein at least a portion, and ideally most or all, of the raised flange comprises resiliently deformable material. In such a case, the curved edge and flange are preferably integrally formed. Thus, a single gasket preferably comprises the curved edge and the flange. In one embodiment of the invention, a ratio of a width of the flange to a minor diameter of the cavity is between 1:50 and 1:10, preferably about 1:12.

The resiliently deformable material is preferably silicone rubber, however other suitable material performing the same function are envisaged.

In the thermoforming step of the process of the invention, the film is heated by a heating plate having at least one concave depression which in use overlies the at least one cavity, wherein the heating step involves the step of bringing the film into intimate contact with the or each depression. The use of a heating plate having concave depressions ensures that the film when heated thermoforms uniformly which results in a package having less weak spots.

In one embodiment of the invention, intimate contact between the film and the concave depression is achieved by exerting a vacuum between the depression and the film. In this regard the depression may include holes through which the vacuum may be pulled. Alternatively, the heating plate may comprise a porous material. When a vacuum is exerted in this manner, the vacuum should ideally comprise a pressure of up to 1 Bar, and preferably be less that 0.6 Bar. In an alternative embodiment of the invention, the film is forced into intimate contact with the concave depression by blowing air against it. Typically the pressure of the blown air will be less than 5 Bar, preferably less than 3 Bar. The heating plate preferably has a temperature in the region of 100 to 120 degrees C., and ideally is approximately 110 degrees C. Although the time the film contacts the heating plate depends to a large extent on the type of film used and the temperature of the heating plate, the time of contact between the film and the plate should be in the region 0.1 to 5 seconds, preferably 0.5 to 1 seconds, ideally approximately 700 milliseconds.

In a particularly preferred embodiment of the invention, the at least one concave depression is circular. In such a case it is preferable that the ratio of the diameter of the depression to the ratio of the depth of the depression is between 4:1 and 50:1, typically between 5:1 and 40:1, suitably between 7:1 and 30:1, ideally between 8:1 and 20:1. In a most preferable embodiment, the ratio is approximately 10:1. Thus in an embodiment of the invention which will be described in further detail below, the concave depression is circular having a diameter of approximately 50 mm and a depth of about 5 mm.

Ideally, the concave depression has a radiussed edge. Preferably the depression has a base having a radius of curvature, wherein the ratio of the radius of curvature of the base to the radius of curvature of the edge is preferably between 5:1 to 1:1, and most preferably is about 2:1. Typically, a single plate may have a plurality of concave depressions which in most instances will correspond to an equal number of cavities in the forming die. In one embodiment of the invention the film is a water-soluble film. Ideally the package contains a liquid, gel or other type of fluent composition. Preferably, the liquid comprises a detergent or any other type of active agent used in the machine washing of laundry or dishes. In another embodiment of the invention, the package contains a bathing or shower gel composition or any other type of personal care composition.

DETAILED DESCRIPTION OF THE INVENTION

The invention will be more clearly understood from the following description of some embodiment thereof, given by way of example only.

EXAMPLE

In this example a thermoforming process is described where a number of recesses are formed in a single sheet using a forming die having a plurality of cavities with dimensions corresponding generally to the dimensions of the packages to be produced. Further, a single heating plate is used for moulding the film for all the cavities, and in the same way a single sealing plate is described.

A first sheet of polyvinyl alcohol film is drawn over a forming die so that the film is placed over the plurality of forming cavities in the die. Each cavity is generally dome shape having a round edge, the edges of the cavities further being radiussed to remove any sharp edges which might damage the film during the forming or sealing steps of the process. Each cavity further includes a raised surrounding flange. In order to maximise package strength, the film is delivered to the forming die in a crease free form and with minimum tension. In the forming step, the film is heated to 100 to 120 degrees C., preferably approximately 110 degrees C., for up to 5 seconds, preferably approximately 700 micro seconds. A heating plate is used to heat the film, which plate is positioned to superpose the forming die. The plate includes a plurality concave depressions which correspond to the recesses on the forming die. During this preheating step, a vacuum is pulled through the pre-heating plate to ensure intimate contact between the film and the pre-heating plate, this intimate contact ensuring that the film is heated evenly and uniformly (the extent of the vacuum is dependant of the thermoforming conditions and the type of film used, however in the present context a vacuum of less than 0.6 bar was found to be suitable) Non-uniform heating results in a formed package having weak spots. In addition to the vacuum, it is possible to blow air against the film to force it into intimate contact with the preheating plate.

The thermoformed film is thus moulded into the cavities forming a plurality of recesses which, once formed, are retained in their thermoformed orientation by the application of a vacuum through the walls of the cavities. This vacuum is maintained at least until the packages are sealed. Once the recesses are formed and held in position by the vacuum, the composition, in this case a liquid detergent, is added to each of the recesses. The fact that formed recesses are retained in their formed orientation by the vacuum substantially prevents the formed film shrinking, which if not prevented could result in some of the composition in the recesses spilling out of the recess and onto that portion of film which overlies the sealing flange resulting in poor sealing. A second sheet of polyvinyl alcohol film is then superposed on the first sheet covering the filled recesses and heat sealed thereto using a heating plate. In this case the heat sealing plate, which is flat, operates at a temperature of about 140 to 160 degrees centigrade, and contacts the films for 1 to 2 seconds and with a force of 8 to 30 kg/cm2, preferably 10 to 20 kg/cm2. The raised flanges surrounding each cavity ensures that the films are sealed together along the flange to form a continuous closed seal. The radiussed edge of each cavity is at least partly formed a by a resiliently deformable material, such as for example silicone rubber. This results in reduced force being applied at the inner edge of the sealing flange to avoid heat/pressure damage to the film.

Once sealed, the packages formed are separated from the web of sheet film using cutting means. At this stage it is possible to release the vacuum on the die, and eject the formed packages from the forming die. In this way the packages are formed, filled and sealed while nesting in the forming die. In addition they may be cut while in the forming die as well.

During the forming, filling and sealing steps of the process, the relative humidity of the atmosphere is controlled at ca. 50%. This is done to maintain the heat sealing characteristics of the film. When handling thinner films, it may be necessary to reduce the relative humidity to ensure that the films have a relatively low degree of plasticisation and as such tend to be stiffer resulting in easier handling. The actual specific RH of the atmosphere needed will vary according to the temperature of the environment and the type of film used, however for temperatures in the region of 20 degrees C., the RH should be in the region of 30 to 50% depending on the thickness and elasticity of the film.

The invention is not limited to the embodiments hereinbefore described which may be varied in both construction, detail and process step without departing from the spirit of the invention.

What is claimed is:

1. A process for producing a thermoformed package comprising the steps of:

placing a first sheet of film over a forming die having at least one forming cavity;

heating the film;

moulding the film into the at least one cavity thereby forming at least one recess in the film;

placing a detergent or personal care composition in the form of a liquid or gel in the at least one formed recess; and sealing a second sheet of film across the at least one formed recess to produce at least one closed package, the process being characterized in that, once formed, the or each recess is substantially retained in its formed orientation by the application of a vacuum through the or each cavity, which vacuum is maintained at least until completion of the sealing step.

2. A process as claimed in claim 1 in which the vacuum is applied through at least one aperture in the forming cavity.

3. A process as claimed in claim 2 in which the or each forming cavity includes a plurality of apertures through which the vacuum is applied.

* * * * *